US006101360A

United States Patent [19]

Hara et al.

[11] Patent Number: 6,101,360

[45] **Date of Patent: *Aug. 8, 2000**

[54] IMAGE FORMING APPARATUS, INTERMEDIATE TRANSFER BELT AND PROCESS FOR PRODUCING THE SAME

[75] Inventors: Yukio Hara; Shinichi Ishigame, both of Ebina, Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/923,144

[22] Filed: Sep. 4, 1997

[30] Foreign Application Priority Data

Sep. 6, 1996 [JP] Japan ..... 8-236011

[51] Int. Cl.[7] ..... G03G 15/16

[52] U.S. Cl. ..... 399/308; 399/302

[58] Field of Search ..... 399/297, 302, 399/308, 310, 313, 314; 430/126

[56] References Cited

U.S. PATENT DOCUMENTS

| | | | |
|---|---|---|---|
| 5,585,905 | 12/1996 | Mammino et al. | 399/308 |
| 5,671,464 | 9/1997 | Kubota | 399/302 X |
| 5,715,510 | 2/1998 | Kusaba et al. | 399/308 |
| 5,732,314 | 3/1998 | Tsukida et al. | 399/302 |

FOREIGN PATENT DOCUMENTS

| | | |
|---|---|---|
| 62-206567 | 9/1987 | Japan . |
| 63-311263 | 12/1988 | Japan . |
| 5-200904 | 8/1993 | Japan . |
| 6-95521 | 4/1994 | Japan . |
| 6-149079 | 5/1994 | Japan . |
| 6-149081 | 5/1994 | Japan . |
| 6-149083 | 5/1994 | Japan . |
| 6-228335 | 8/1994 | Japan . |

*Primary Examiner*—Sandra Brase
*Attorney, Agent, or Firm*—Oliff & Berridge, PLC

[57] ABSTRACT

An image forming apparatus whose secondary transfer member is provided with an intermediate transfer belt 6, a bias roll 9 for use in secondarily transferring an unfixed toner image on the intermediate transfer belt onto a recording medium P, and a backup roll which is located in opposition to the bias roll and used for supporting the intermediate transfer belt from the back of the intermediate transfer belt. The intermediate transfer belt is made of belt material of three-layer structure comprising a base made of plastics such as polyimide resin and an electrically-conductive agent, the combination of which has a Young's modulus of 35000 kg/cm$^2$ or greater, an intermediate layer made of elastic material such as fluororubber, silicone rubber or the like and a surface layer made of material having low surface energy such as fluoroplastics. The thickness of each layer is as follows: the base is 50 $\mu$m or thicker; the intermediate layer is three times as thick as a mean tone particle diameter or thicker; and the surface layer is 5 $\mu$m or thicker.

10 Claims, 2 Drawing Sheets

IMAGE FORMING APPARATUS, INTERMEDIATE TRANSFER BELT AND PROCESS FOR PRODUCING THE SAME

BACKGROUND OF THE INVENTION

The present invention relates to an image forming apparatus utilizing an electrophotographic system comprising an electrophotographic copying machine, a laser printer and a facsimile or a combination of these as OA (Office Automation) equipment. More particularly, the present invention relates to an image forming apparatus for use in obtaining reproduced images by primarily transferring a toner image formed on an image carrier onto an intermediate transfer belt once and then transferring the toner image onto a recording medium such as copying paper; to such an intermediate transfer belt; and to a process for the production of the same.

In a typical image forming apparatus utilizing the electrophotographic system, a uniform electric charge is formed on a photosensitive material as an image carrier made of inorganic or organic photoconductive material, then an electrostatic latent image is formed by means of a laser beam resulting from modulating an image signal, for example, and the electrostatic latent image is developed into a visible toner image by the use of electrically charged toner. Further, the toner image is transferred directly or via an intermediate transfer body to a recording medium such as copying paper in order to obtain a desired reproduced image.

The Japanese Patent Application Publication No. Sho 62-206567, for example, discloses an image forming apparatus employing a system in which a toner image formed on an image carrier is primarily transferred onto an intermediate transfer body and the toner image on the intermediate transfer body is transferred onto a recording medium.

With respect to transfer belt materials for use in image forming apparatus of such an intermediate transfer belt system, there have been proposed the following electrically-conductive endless belts made by adding an electrically-conductive agent such as carbon black to thermoplastic resin: for example, polyvinylidene fluoride (PVDF) (the Japanese Patent Application Publication Nos. Hei 5-200904 and Hei 6-228335); polycarbonate (PC) (the Japanese Patent Application Publication No. Hei 6-95521); polyalkylene terephthalate (PAT) (the Japanese Patent Application Publication No. Hei 6-149081); a blend of PAT and PC (the Japanese Patent Application Publication No. Hei 6-149083); and a blend of ethylene tetrafluoroethylene (TFE) copolymer (ETFE) and PC, a blend of ETFE and PAT, a blend of ETFE, PC and PAT (the Japanese Patent Application Publication No. Hei 6-149079).

Since the aforesaid electrically-conductive material made of thermoplastic resin such as PVDF, PC or the like is inferior in the Young's modulus; namely, 14000 kg/cm$^2$ or lower, there exist problems arising from the increased deformation of the belt due to the stress applied during the driving of the belt, inability to obtain a high-quality transfer image with stability when the material is used for the intermediate transfer belt, and the inferior durability of the belt as cracks may occur in the end portion of the belt during its operation.

As a material excellent in mechanical characteristics, thermosetting polyimide resin, for example, may be mentioned. A seamless belt made of polyimide resin with carbon black dispersed therein was proposed in the Japanese Patent Application Publication No. Sho 63-311263, for example. The process of producing this endless belt comprises the steps of dispersing carbon black as an electrically-conductive agent in a polyamide acid solution as a precursor, flow-casting the dispersion on a metal drum and drying it, casting the film peeled off the drum at high temperatures to obtain a polyimide film, and cutting the film in lengths.

The generally-known process of forming such a film includes injecting into a tubular mold a polymer solution with carbon black dispersed therein, rotating the tubular mold at 1000–2000 rpm while heating it at, for example, 110–150° C., forming the solution into a film by centrifugal molding, removing the semi-hardened film thus obtained from the mold and putting it on an iron core, and letting a polyimide reaction (ring closure reaction) progress at 300–500° C. so as to effect proper hardening.

In the case of a rotary molding method such as the aforesaid centrifugal molding method, however, minute irregularities are formed on the surface of the film when the solvent is unevenly evaporated during the molding and proper hardening process. When the intermediate transfer belt made of the film like this is used to make secondary transfer, there also develops a problem causing minute inadequate transfer (hollow character) and the like to the image transferred to the recording medium. In order to obtain a smooth film, on the other hand, it takes hours to perform the molding and hardening process for evaporating and drying the solvent and hardening the polyamide acid, thus increasing the belt production cost.

Since the polyimide resin is superb in mechanical characteristics, the intermediate transfer belt is less deformed because of the pressing force when the paper is pressed by a bias roll against the belt. When the toner image is transferred electrostatically onto the intermediate transfer belt by acting an electric field thereon, the load applied by the pressing force of the bias roll is concentrated in the secondary transfer portion. Consequently, the toner image is aggregated and the charge density is raised, whereby the toner polarity may be varied as discharge is caused in the interior of the toner layer.

This factor develops a problem arising from poor image quality in that there appears a hollow character in which a line image is partially missing.

In the prior art examples, the electrically-conductive belt materials made of thermoplastic resin which is inferior in mechanical characteristics produce a great deal of deformation against the stress applied thereto while they are being driven and make transfer images of good quality unavailable with stability. On the other hand, the belt materials made of thermosetting resin excellent in mechanical characteristics are also problematical in that since the belts are less deformed against the pressing force of the bias roll in the secondary transfer portion, the aggregation of the toner image brings about poor image quality.

Further, a belt material of single layer structure made up by the rotary molding using electrically-conductive polyimide resin develops the problem of causing inadequate transfer to a transfer image as minute irregularities originating from variations in solvent evaporation are formed on the surface thereof. In the case of a belt material of double layer structure whose surface is covered with an elastic member such as silicone rubber, the problem is that a toner image is not transferred to a recording medium at the time of the secondary transfer because of the viscosity properties of the rubber material.

SUMMARY OF THE INVENTION

It is therefore an object of the present invention intended to solve the foregoing problems to provide an image forming apparatus capable of preventing poor image quality from occurring because a belt material is less deformed against the stress applied while the belt is being driven and of offering excellent transferability; an intermediate transfer belt; and a process for the production of the same.

The present inventors have made studies assiduously to solve the foregoing problems and found out that the object can be accomplished by a belt material of three-layer structure comprising a base which is excellent in mechanical characteristics, a surface layer made of non-adhesive material, and elastic material juxtaposed between the base and the surface layer in order to avoid the concentration of stress according to the present invention.

More specifically, an image forming apparatus according to the present invention comprises an image carrier for forming an electrostatic latent image corresponding to image information, a developing unit for making the electrostatic latent image formed on the image carrier visible as a toner image by the use of toner, an intermediate transfer belt onto which the toner image carried by the image carrier is primarily transferred, a bias roll for use in secondarily transferring an unfixed toner image on the intermediate transfer belt onto a recording medium, and a backup roll which is located in opposition to the bias roll and used for supporting the intermediate transfer belt from the back of the intermediate transfer belt, and is characterized in that the intermediate transfer belt is made of belt material of three-layer structure comprising a base made of plastics and an electrically-conductive agent, the combination of which has a Young's modulus of 35000 kg/cm$^2$ or greater, an intermediate layer made of elastic material, and a surface layer made of material having low surface energy at a contact angle of 90° or greater with a waterdrop in terms of its wetting properties.

The present invention includes the aforesaid intermediate transfer belt of three-layer structure.

The present invention also features a process for the production of a three-layer intermediate transfer belt for an image forming apparatus, which process comprises the steps of applying a coating liquid containing fluoro-polymer material to a base made of plastics and an electrically-conductive agent, the combination of which has a Young's modulus of 35000 kg/cm$^2$ or greater, and heating the coating at 250° C. or higher so as to form an intermediate layer made of fluororubber and a surface layer made of fluoroplastics.

DETAILED DESCRIPTION OF THE PREFERRED EMBODIMENTS

A detailed description will subsequently be given of the present invention.

Figure 1:
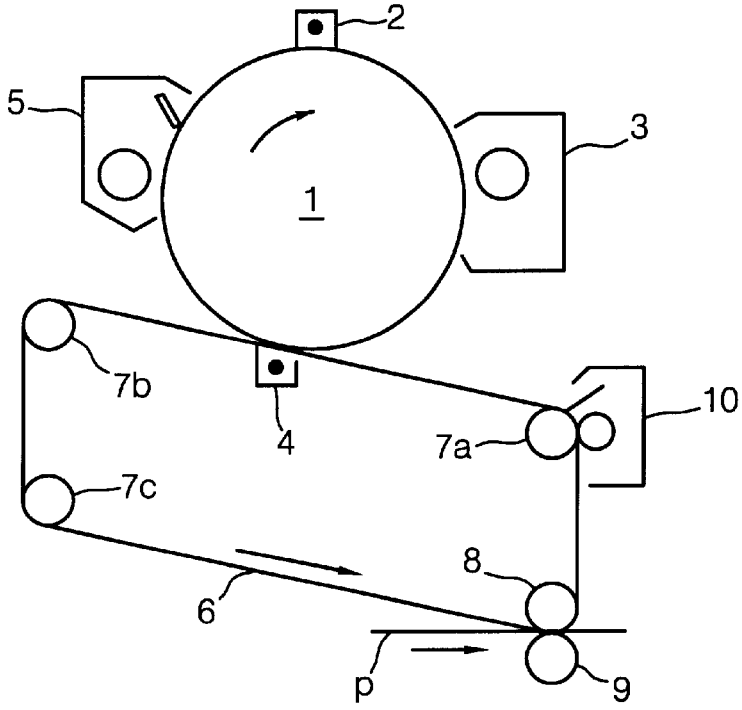
FIG. 1 is a schematic diagram illustrating the positional relation of an intermediate transfer belt to an image forming apparatus equipped with principal component members.

FIG. 1 is a schematic diagram of an intermediate transfer belt in positional relation to an image forming apparatus equipped with principal component members.

As shown in FIG. 1, a charging device 2, a developing unit 3, a primary transfer device 4, a cleaning device 5 and so forth are arranged on the peripheral face of an image carrier 1 which is constituted of a photosensitive drum along the rotational direction of the image carrier 1. Further, an intermediate transfer belt 6 is stretched from a belt conveyer roll 7*a* to belt conveyer rolls 7*b*, 7*c* and a backup roll 8. While kept in contact with the surface of the image carrier 1, the intermediate transfer belt 6 is moved in the direction of an arrow and caused to carry an unfixed toner image primarily transferred by the primary transfer device 4 when passed between the image carrier 1 and the primary transfer device 4 disposed in opposition thereto. A bias roll 9 and a belt cleaner 10 are positioned via the intermediate transfer belt 6 opposite to the backup roll 8 and the belt conveyer roll 7*a*, respectively. The backup roll 8 is used to support the intermediate transfer belt 6 from behind. Transfer voltage is applied between the backup roll 8 and the bias roll 9, and the unfixed toner image carried on the intermediate transfer belt 6 is secondarily transferred onto a recording medium such as copying paper or the like (hereinafter called the "paper P").

The primary transfer device 4 includes a corona transfer device such a corotron, a transfer roll and a transfer blade. To the primary transfer device 4, a voltage of 1–4 kV is applied and because of an electric field generated between the image carrier 1 and the primary transfer device 4, the toner carried by the image carrier 1 is primarily transferred to the intermediate transfer belt 6. The aforesaid secondary transfer voltage may be applied to the core metal of the backup roll 8, an electrically-conductive electrode roll forced to contact the roll 8 or the bias roll 9.

The backup roll 8 forms an electrode in opposition to the bias roll 9. The backup roll 8 may be of single- or multi-layer structure. In the case of a single-layer structure, for example, the roll is formed by blending electrically-conductive fine powder of carbon black or the like with silicone rubber, urethane rubber EPD or the like. In the case of a double-layer structure, the structure comprises a roll of a single layer whose volume resistivity is properly regulated and which is used as the lowermost layer, and an electrically-conductive surface layer whose outer peripheral face is covered with, for example, fluoroplastics. As the fluoroplastics, use may be made FEP (TFE - HFP copolymer), PFA or the like. Further, the hardness of the backup roll 8 preferably ranges from 60 to 75° according to Asker C.

While the toner image carried by the image carrier 1 is being primarily transferred onto the intermediate transfer belt 6, the bias roll 9 constituting a transfer electrode is separated from the intermediate transfer belt 6 and when the toner image carried by the intermediate transfer belt 6 is secondarily transferred onto paper P, the bias roll 9 is brought into contact with the intermediate transfer belt 6 so as to press the paper P against the backup roll 8.

The layer structure of the bias roll 9 is not particularly limited but may be such that the roll comprises a core layer and a coating layer covering the surface thereof in a case when it is of, for example, two-layer structure. The core layer is formed of silicone rubber, urethane rubber, EPDM or the like with electrically-conductive fine powder dispersed therein or their foam, whereas the coating layer is preferably formed of the aforesaid fluoroplastics with electrically-conductive fine powder dispersed therein. The hardness of the bias roll 9 ranges from 30 to 45° according to Asker C.

The belt cleaner 10 is used for removing the residual toner on the intermediate transfer belt 6 after the secondary transfer.

Figure 2:
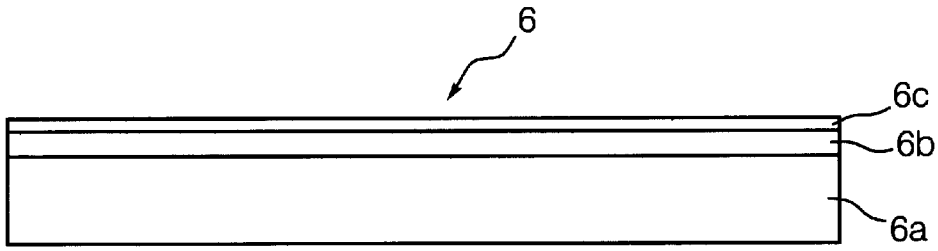
FIG. 2 is a schematic diagram of the lateral sectional structure of the intermediate transfer belt according to the present invention.

According to the present invention, the intermediate transfer belt 6 is, as shown in FIG. 2, of three-layer structure comprising a film-like base 6*a* which is made of plastic material and an electrically-conductive agent as ingredients and offers excellent mechanical characteristics, an intermediate layer 6*b* made of elastic material, and a surface layer 6*c* made of material having low surface energy.

As the plastic material used for forming the base, thermosetting polyimide, thermoplastic polyethersulfon and the like are enumerated. These kinds of plastics feature, when used for a belt, less deformation during the driving of the belt than what the belt made of the conventional thermoplastic resin such as PC and PVDF undergoes.

As the electrically-conductive agent, the following electrically-conductive metal oxides in addition to carbon black and graphite can be enumerated: tin oxide, zinc oxide, antimony oxide, indium oxide, titanium acid potassium, antimony oxide—tin oxide composite oxide (ATO), indium oxide—tin oxide composite oxide (ITO) and the like. The electrically-conductive metal oxide may be what is coated with insulating fine particles of barium sulfate, magnesium silicate, calcium carbonate or the like. As a preferred metal oxide, the following can be enumerated: composite tin oxide having a mean particle diameter of 0.1 μm (product name: UF); zinc oxide of 0.3 μm (Bustran Type - II); barium sulfate having a mean particle diameter of 0.4 μm whose surface is coated with tin oxide (Bustran Type - IV); ATO of 0.2 μm; ITO of 0.2 μm; and so on. More than one kind of electrically-conductive agent may be simultaneously used.

In order to improve the compatibility of the electrically-conductive metal oxide with the resin used for forming the base, what has been subjected to surface treatment with a coupler is preferred for use. Further, the surface resistivity of the base preferably ranges from $10^{10}$–$10^{15}$ Ω/□.

Incidentally, the elongation shrinkage (displacement) of a belt due to disturbance (load fluctuation) during the driving of the belt is known to be inversely proportional to the Young's modulus of the belt material. In other words, the relation between the Young's modulus of the belt material and the displacement of the belt due to the load fluctuation during the driving thereof can be expressed by an equation (1) below.

$$\Delta 1=\alpha\cdot P\cdot 1/(t\cdot w\cdot E) \quad (1)$$

Δ1: displacement (μm) of belt

μ: coefficient

P: load (N)

1: length (mm) of the belt between two tension rolls t: thickness (mm)

w: width (mm) of the belt

E: Young's modulus ($N/mm^2$) of the belt material

The Young's modulus of the conventional thermoplastic resin such as PC, PVDF or the like is 24000 $kg/cm^2$ or lower when carbon black is dispersed. On the other hand, the Young's modulus of the base according to the present invention is set to 35000 $kg/cm^2$ or greater. Therefore, the elongation·shrinkage (displacement) of a belt due to disturbance during the driving of the belt, so that a transfer image of high quality is obtainable by juxtaposing an intermediate layer therewith.

In order to obtain a transfer image of good quality by decreasing the displacement of belt due to disturbance during the driving of the belt, the thickness of the base is preferably 50 μm or greater. If the base is excessively thick, the deformation of the surface of the belt tends to become greater and when a color image is formed, the position of a multiplex toner image shifts, thus causing a color shift. Consequently, the thickness of the base is made to range from 50–150 μm, preferably from 70–100 μm.

The aforesaid intermediate layer is made of elastic material to avoid the concentration of stress applied by the pressing force of the bias roll. The elastic material is not particularly limited but may be any rubber material; more specifically, isoprene rubber, chloroprene rubber, butyl rubber, epichlorohydrin rubber, norbornane rubber, fluororubber, silicone rubber, urethane rubber, acrylic rubber, EPDM, SBR, NBR, acrylonitrile butadiene styrene rubber and the like can be enumerated. As the intermediate layer is normally formed by the coating method, heat-resistant elastic material such as fluororubber and silicone rubber is preferred for use.

As the fluororubber, PTFE, PVDF, polyhexafluoropropylene (PHFP), polychlorotrifluoroethylene, TFE—perfluoroalkyl- vinylether copolymer (PFA), ETFE, FEP, PFA—FEP copolymer and the like can be enumerated. Further, as the silicone rubber, a one-pack RTV (Room Temperature Vulcanizing) type having a hardness of (JIS A) 20–60° is preferred for use.

In order to prevent the hollow character from occurring, the thickness of the intermediate layer is preferably not less than three times as great as the mean particle diameter of toner. In this case, the mean particle diameter of toner means its volumetric mean particle diameter and toner in the range of 4 to 13 μm is normally used. When toner having a volumetric means particle diameter of 7 μm is used, for example, an intermediate layer having a thickness of 21 μm or greater is preferred for use.

If the elastic material is too thick, the difference in the quantity of deformation between the surface and underside of the belt in the regions of tension rolls (7*a*–7*c*, 8) tends to become larger and therefore the thickness of the intermediate layer is generally set to 80 μm or greater; a preferred range of such thickness is from 30 to 65 μm.

The surface layer is made of material having a contact angle of 90° or greater with a waterdrop when indicated in terms of water wetting properties. The "water wetting properties" are displayed so that when the material used to form the surface layer is employed as a test piece, the contact angle between the plane of the test piece and the waterdrop is displayed as a yardstick.

Figure 3:
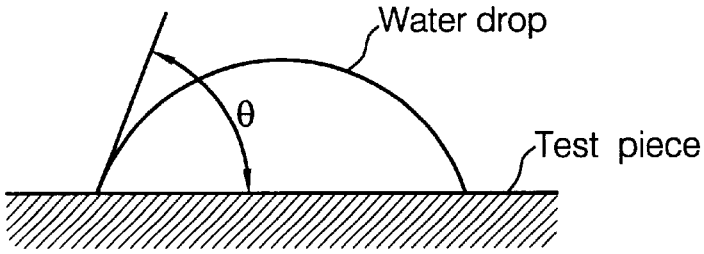
FIG. 3 is a sectional view of the surface of a test piece and a waterdrop explanatory of a contact angle as a yardstick of surface energy.

When a waterdrop is placed on the surface of the test piece, the surface tension τs of the test piece, the interface tension τi between the liquid and the test piece, and the surface tension τl of the liquid are balanced, and a certain fixed shape is formed as shown in FIG. 3. If the waterdrop is small enough to make the influence of gravity ignorable then, a Young's equation (2) may be established.

$$-\tau s=\tau i+\tau l\cos\theta \quad (2)$$

A "material having low surface energy" according to the present invention means what has the aforesaid contact angle of 90° or greater.

With respect to the surface energy, moreover, an additional description will be given from the standpoint of "wetting." The wetting from a macro-viewpoint refers to a phenomenon in which the contact surface between a solid and a gas is voluntarily replaced with the contact surface between the solid and a liquid, which is accompanied by a reduction in free energy in the system. From a micro-viewpoint, further, it is a phenomenon which is seen when the molecule-to-molecule attraction (adhesion) between the solid and the liquid is greater than the molecule-to-molecule attraction of the liquid, that is, the aggregating force.

The variation of the free energy starts from the system in which the solid which has already become wet is brought into contact with the liquid and is known to be the inversion of the symbol (±) of a job necessary for separating the solid from the liquid. The job W is expressed by the following equation (3):

$$W=\tau sg+\tau lg-\tau sl \quad (3)$$

In this case, τsg, τlg, τsl represent interface free energy between solid/gas, liquid/gas, liquid/gas, and are synonymous with τg, τl, τi in Eq. (2) above, respectively. As is obvious from Eq. (2) above, though the variation of the free energy includes the free surface energy of the solid and the free interface energy between solid/liquid, the contact angle between the solid and the waterdrop is utilized because both of them are not directly measurable. In other words, the aforesaid Young's equation is established between the aforesaid τsg, τlg, τsl and the contact angle θ.

$$\cos\theta=(\tau sg-\tau sl)/\tau lg \quad (2')$$

Therefore, according to the present invention, it has been decided that the surface energy of the material used to form the surface layer is displayed with the contact angle θ between the plane of the surface layer And the waterdrop.

As the material above, fluoroplastics like the rubber material illustrated as the elastic material used to form the aforesaid intermediate layer, amid-modified resin, urethane resin and the like can be enumerated. As these materials have low surface energy, they are non-adhesive and have the property of making toner hardly adhere to the surface of the belt. Consequently, secondary transfer from the belt material to paper is facilitated, whereby images of good quality are obtainable.

The thickness of the surface layer is preferably set to 5 μm or less lest the elasticity of the intermediate layer is damaged, and the lower limit value is only needed to suppress the adhesion of the surface of the belt due to the elastic material used to form the intermediate layer and usually about 1 μm.

The thickness of the whole intermediate transfer belt of three-layer structure generally ranges from 70–200 μm and preferably from 100–150 μm. If the thickness exceeds 200 μm, the difference in the quantity of deformation between the surface and underside of the belt in the region of the tension roll grows greater for the same reason as in the case of an intermediate layer, thus developing the problem of a transfer shift.

It is important for the intermediate transfer belt to have a predetermined surface resistivity in order to transfer a toner image onto the intermediate transfer belt under the electrostatic transfer method. If the surface resistivity is too low, the toner image transferred on the intermediate transfer belt once will be back to the image carrier, that is, a retransfer phenomenon will occur because an excessive current is caused to flow between the intermediate transfer belt and the image carrier. If the surface resistivity is too high, on the other hand, peeling discharge will occur when the intermediate transfer belt is separated from the image carrier because the intermediate transfer belt is charged with electricity too much when the toner image is transferred, thus causing the toner image transferred onto the intermediate transfer belt to scatter when the peeling discharge occurs. In order to avoid these phenomena, it is appropriate to set the surface resistivity of the intermediate transfer belt to $10^{11}$–$10^{15}$ Ω/□ and preferably to $10^{12}$–$10^{14}$ Ω/□. The surface resistivity of the intermediate transfer belt may be adjusted, as occasion demands, by dispersing an electrically-conductive agent in not only the base but also the intermediate layer and one or both sides of the surface layer.

The intermediate transfer belt according to the present invention is manufactured through the following steps:

First, a plastic material with an electrically-conductive agent such as carbon black dispersed therein is formed into a film so as to provide a base. When the plastic material is thermoplastic resin such as polyestersulfon excellent in mechanical characteristics, for example, the base is made formable by subjecting the plastic material blended with the electrically-conductive agent to the usual injection molding, extrusion molding, compression molding or the like. In a case where the plastic material is thermosetting resin such as polyimide resin, the intermediate transfer belt is normally formed through the condensation polymerization of tetracarboxylic acid 2-anhydride and diamine or di-isocyanate.

In the former diamine method, the electrically-conductive agent is added to an organic polar solvent of polyamide acid to be synthesized and both of them are sufficiently blended together by a mixer to prepare a film-producing undiluted solution. In the latter di-isocyanate method, a polyimide solution or polyimide powder to be synthesized is dissolved into an organic polar solvent again and the electrically-conductive agent is added thereto to prepare a film-producing undiluted solution. In any one of the methods above, the film-producing undiluted solution is passed through a filter before the film is formed so that the large-sized electrically-conductive agent and foreign material are preferably removed by secondary aggregation. It may also be acceptable to add such an electrically-conductive agent to the polymer material beforehand.

The method of forming a film may be either rotary molding method such as the centrifugal molding method or otherwise casing method in which the film is formed on a metal sheet. In these forming methods, the film-producing undiluted solution from a slit die is cast into a cylindrical metal mold or onto a metal sheet-like endless belt. The thickness of a film to be formed is regulated mainly in accordance with the polymer concentration in the film-producing undiluted solution and the quantity of extrusion, the quantity of electrically-conductive agent to be added, the speed of the cylindrical metal mold (the former) or the speed of taking up the liquid film (the latter).

In order to suppress the formation of minute irregularities on the surface of a film to be formed, it is desired to raise the temperature of drying the film-producing undiluted solution stepwise.

In a case where the polymer in the film-producing undiluted solution is polyamide acid, for example, the casting film in the cylindrical metal mold or on the belt is first heated at 120° C. for about two hours and then the polar solvent is evaporated to obtain a self-supporting film in a semi-hardened state. Subsequently, the film is heated at 120–350° C. for about 30–150 minutes so as to evaporate the solvent completely. This process step is not intended to raise the temperature from 120° C. up to 350° C. all at once but to raise the temperature stepwise or gradually and continuously in a suitable temperature range. Then the film is heated at 420–450° C. for 20–30 minutes and by dehydrating and condensing the polyamide acid, whereby a base with the electrically-conductive agent dispersed in the polyimide resin is formed. When the polymer in the film-producing undiluted solution is polyimide, the dehydrating-condensing step may be omitted.

It is preferred to apply the casting process to a film to be formed at any desired step from a point of time the self-supporting film is formed as the solvent is evaporated at the drying step until the termination of the aforesaid condensing step.

The intermediate layer made of the elastic material is stacked up on the base. The intermediate layer is formed by coating the surface of the base with the liquid rubber material by, for example, the dip coating method, the air spray coating method or the like. As the rubber material, use can preferably be made of a one-pack RTV type silicone rubber which hardens at room temperature.

The intermediate layer is further coated with the surface layer made of material having low surface energy. This surface layer is formed through a method similar to what is used for forming the intermediate layer. When the intermediate layer and the surface layer are formed, they may be subjected to a primer process as occasion demands.

A preferred method for the formation of the intermediate layer and the surface layer includes first applying onto the base the fluororubber material modified with various functional groups and polymer material together with aqueous emulsion containing the aforesaid fluoroplastic material and heating the coating at 250–300° C. for 10–30 minutes. According to this method, a surface layer 1–2 μm thick and an intermediate layer 20–80 μm thick are simultaneously formable. A plastic layer is formed on the surface of the coated layer made of fluoro-polymer material and the rubber material layer is formed on the inner side thereof due to the reason for the phase separation of the plastic material from the rubber material since the surface energy of the fluoroplastics is extremely low. This tendency becomes conspicuous as the heating temperature is raised. On the other hand, hardening is preferably carried out at lower temperatures in order to suppress the deterioration of the base and the intermediate layer, so that the surface layer and the intermediate layer are formed within the aforesaid temperature range. For the fluoro-polymer material, FEP (mp: 275° C.), ETFE (mp: 270° C.) having a melting point of 300° C. or lower and the like are preferred.

When the base is formed under the rotary molding method, the belt material thus formed as described above is cut in widths and in the case of a casting method, the belt material is properly cut in lengths and widths, and the end portions of the sheet are bonded with an adhesive, whereby the intermediate transfer belt according to the present invention is manufactured.

The functions of the present invention are as follows:

The function of the image forming apparatus as in aspect 1 according to the present invention will subsequently be described.

The electrostatic latent image formed on the image carrier 1 according to image information is developed with toner within the developing unit 3 before being made visible as an unfixed toner image. While being carried by the image carrier 1, the toner image is transferred onto the intermediate transfer belt 6 in the primary transfer portion. When a multicolor image is transferred, the primary transfer is repeated on a toner color basis, toner of different colors being accommodated within the developing unit 3.

When the intermediate transfer belt 6 carrying a toner image bearing a desired hue is move to the secondary transfer portion upon the termination of the primary transfer of the toner image from the image carrier 1 onto the intermediate transfer belt 6, paper P is conveyed to the secondary transfer portion in synchronization therewith. While receiving the pressure contact force applied between the backup roll 8 and the bias roll 9, paper P is passed through the secondary transfer portion, when the toner image carried by the intermediate transfer belt 6 is secondarily transferred from the surface of the intermediate transfer belt 6 onto the paper P by applying the transfer voltage between the rolls 8, 9.

The image forming apparatus as in aspect 1 and the intermediate transfer belt for the image forming apparatus as in aspect 7 according to the present invention are such that the intermediate transfer belt 6 is made of belt material of three-layer structure; the base 6*a* as the lower layer formed of the plastic material and the electrically-conductive agent has a Young's modulus of 35000 kg/cm$^2$ or greater; the intermediate layer 6*b* is formed of elastic material; and the surface layer 6*c* is formed of material having low surface energy.

According to aspects 1, 7, in comparison with conventional PC, PVDF and the like with carbon black dispersed therein, the belt with respect to the stress during the driving of the belt is less deformed since the Young's modulus of the base 6*a* is high. Due to the elasticity of the intermediate layer 6*b*, moreover, the concentration of the pressing force applied by the bias roll 9 can be suppressed in the secondary transfer portion. For this reason, it is possible to eliminate the problem of bringing about poor image quality such as hollow characters in which a line image is partially missing. Since the surface layer 6*c* made of material having low surface energy is non-adhesive, the secondary transfer of the toner image to paper P is facilitated and a transfer image of good quality is made available.

The image forming apparatus as in aspect 2 according to the present invention makes it possible to obtain a transfer image of good quality by limiting the thickness of the base 6*a*, the intermediate layer 6*b* and the surface layer 6*c* to predetermined values. In other words, the displacement of the belt due to the disturbance during the driving of the belt is lowered by setting the thickness of the base 6*a* to 50 μm or greater. Moreover, the hollow character is set free from occurring as the intermediate layer 6*b* is allowed to demonstrate its function as an elastic layer by the thickness thereof is made more than three times as great as the mean particle diameter of toner. Further, the thickness of the surface layer 6*c* os set to 5 μm or less, whereby the elasticity of the intermediate layer 6*b* is prevented from being damaged.

The image forming apparatus as in aspects 3, 4 are such that the base 6*a* is made of carbon black or poly imide resin material with electrically-conductive metal oxide dispersed therein; the intermediate layer 6*a* is made of fluororubber material; and the surface layer 6*c* is made of fluoroplastic material. According to aspects 3, 4, the polyimide resin material with the aforesaid electrically-conductive agent dispersed therein has a Young's modulus as high as 62000 kg/cm$^2$ and is capable of satisfying the mechanical characteristics required for the belt base 6*a*. Further, by dispersing a suitable quantity of electrically-conductive agent in polyimide resin so as to set the surface resistivity of the intermediate transfer belt 6 to a predetermined value within the range of $10^{11}$–$10^{15}$ Ω/□, the primary transfer of the toner image can smoothly be carried out. Since fluoroplastics has low surface energy as exhibited by the aforesaid contact angle θ, for example, the toner image on the intermediate transfer belt 6 is smoothly moved onto paper P at the time of secondary transfer. Further, the use of the same fluororubber material makes it possible to form the intermediate layer 6*b* and the surface layer 6*c* simultaneously.

The image forming apparatus as in aspects 3, 4 according to the present invention are such that the intermediate layer 6*b* as in aspects 3, 4 is formed of silicone rubber material.

When a one-pack RTV type is employed, for example, as the silicone rubber material, the intermediate layer 6*b* can simply be formed.

The process for the production of an intermediate transfer belt for use in the image forming apparatus as in aspect 8 according to the present invention comprises the steps of applying fluoro-polymer material onto the base 6*a* made of plastic material whose Young's modulus is 35000 kg/cm$^2$ or greater and heating the material at 250° C. or greater so as to form the intermediate layer 6*b* made of fluororubber material and the surface layer 6*c* made of fluoroplastic material. Since the surface of the coating layer is hardened into plastic material and so is the inside into rubber material when heated as in aspect 8 according to the present invention, two of the intermediate layer 6*b* and the surface layer 6*c* can simultaneously be formed through the single coating step and the heating step by the use of the same polymer material.

Embodiment

A detailed description will subsequently be given of an embodiment of the present invention, though the present invention is not limited to the following embodiment.

Image Forming Apparatus

Figure 4:
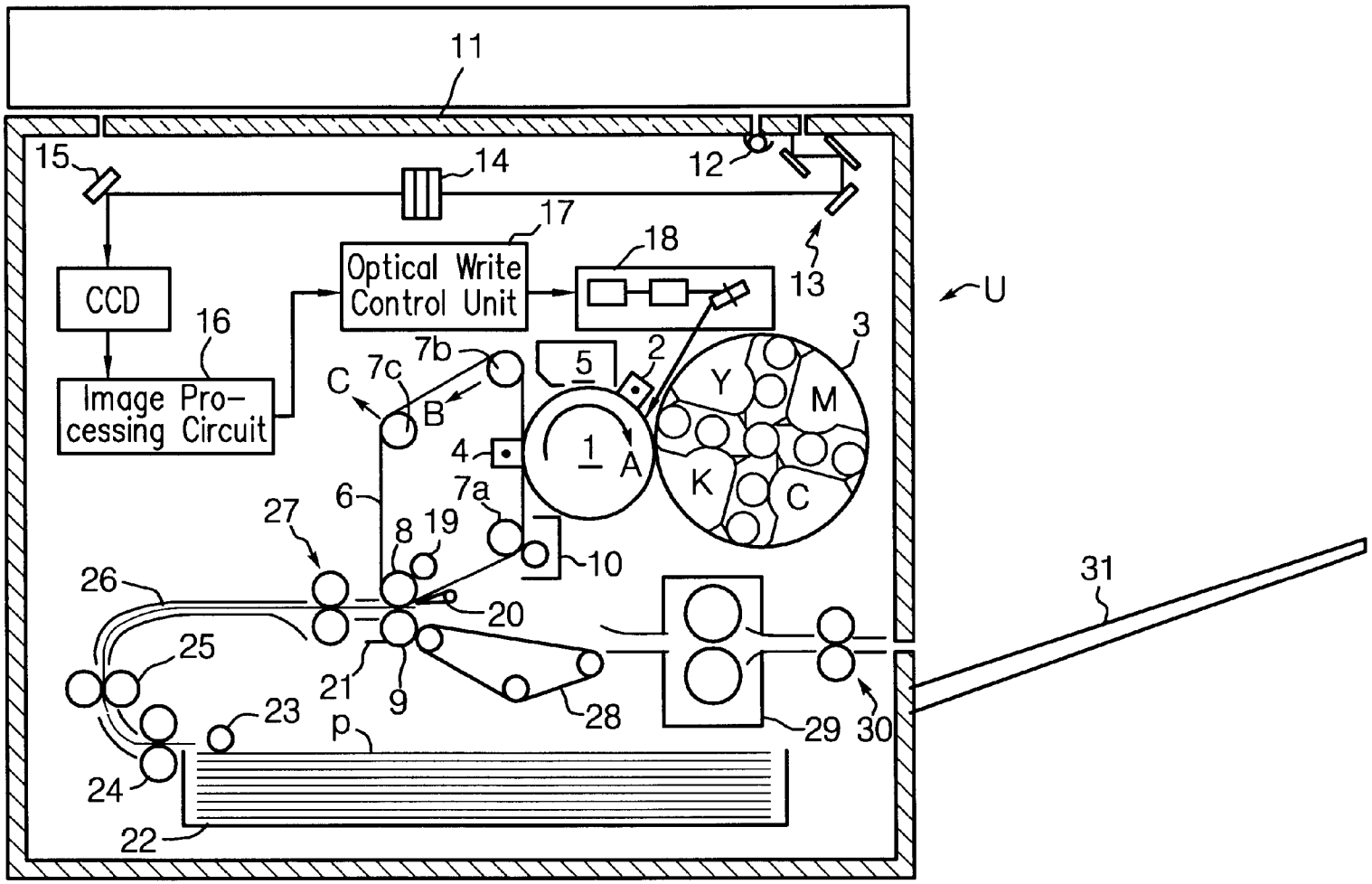
FIG. 4 is an overall diagram of an image forming apparatus embodying the present invention.

FIG. 4 shows a diagram of an overall digital color copying machine equipped with an intermediate transfer belt as an image forming apparatus according to the present invention, wherein like reference characters designate like component parts corresponding in function to those shown in FIG. 1.

As shown in FIG. 4, light emitted from an original illuminating lamp 12 which is movable along the underside of an original (not shown) mounted on a platen 11, and rays of light reflected from the original are focused on CCD in an image reading unit via a moving mirror unit 13, a lens 14 and a fixed mirror 15. The CCD operates to convert the original image into electrical signals on a color basis by means of a number of photoelectric conversion elements and three color filters of blue (B), green (G) and red (R). These electrical signals are input to an image processing circuit 16, which converts the original image read signals that have been input on a color basis into digital signals and stores the digital signals in an image memory.

An optical write control unit 17 reads the image data stored in the image processing circuit 16 at predetermined timing and feeds the results in an optical beam write unit 18. The optical beam write unit 18 writes an electrostatic latent image corresponding to each color to the image carrier 1 constituted of a photosensitive drum rotating in the direction of an arrow A. Around the image carrier 1, there are arranged a charging device 2 for uniformly charging the surface of the image carrier 1 with electricity, a developing unit (developing devices) 3 for developing an electrostatic latent image written to the image carrier 1 into a toner image of each color, a transfer corotron (primary transfer device) 4 for transferring the toner image of each color onto the intermediate transfer belt 6, and a cleaner unit (cleaning device) 5 having a charge eliminator and a cleaning blade.

The developing unit 3 has developing devices each storing black (K), yellow (Y), magenta (M) and cyan (C) toner having a mean particle diameter of 7 $\mu$m and is used for making the electrostatic latent image visible with the toner of each color.

The intermediate transfer belt 6 is stretched over a backup roll 8 and belt conveyer rolls 7*a*, 7*b*, 7*c* and moves in the tangential direction while being kept in contact with the surface of the image carrier 1. According to this embodiment of the invention, the belt conveyer roll 7*a* out of the rolls (7, 8) for stretching the intermediate transfer belt 6 is used as a driving roll and the other rolls (7*b*, 7*c*, 8) are used as driven rolls so that the intermediate transfer belt 6 is moved in the direction of an arrow B. In order to prevent the intermediate transfer belt 6 from bending, the shaft of the belt conveyer roll 7*c* is urged by a spring (not shown) in the direction of an arrow C.

On the back side of the intermediate transfer belt 6, there is arranged a primary transfer portion where the transfer corotron 4 is brought into contact with the surface of the image carrier 1 and the intermediate transfer belt 6. On the surface side of the intermediate transfer belt 6 for carrying an unfixed toner image, on the other hand, there are also disposed a bias roll 9 and a belt cleaner 10 in opposition to the backup roll 8 and the belt conveyer roll 7*a*. Further, an electrode roll 19 connected to a transfer voltage supply is forced into contact with the backup roll 8 to form a secondary transfer portion where the backup roll 8 faces the bias roll 9.

Further, a peeling pawl 20 for peeling paper P carrying the toner image subjected to the secondary transfer from the intermediate transfer belt 6 is disposed in between the backup roll 8 and the belt conveyer roll 7*a*. On the surface of the bias roll 9 is a cleaning blade 21 which is kept in contact therewith, whereby toner particles and paper powder sticking to the surface thereof at the time of the secondary transfer are removed.

Under the body of the image forming apparatus U are a detachable paper feed tray 22 and a pickup roller 23 disposed above the paper feed tray 22.

On the downstream side of the secondary transfer portion are a conveyer belt 28 for conveying paper P carrying the toner image subjected to the secondary transfer, a fixing device 29 for fixing the unfixed toner image on the paper P, a pair of discharge rolls 30 for discharging the paper P with a fixed image formed thereon, and a discharge tray 31 for mounting the paper P discharged.

(Function of the Image Forming Apparatus)

The image carrier 1 rotating in the direction of the arrow A is uniformly charged with electricity by the charging device 2 and an electrostatic latent image is written to the optical beam write unit 18. The electrostatic latent image on the image carrier 1 is developed by the developing unit 3 into an unfixed toner image. The toner image is formed like this: a toner image of first color is initially formed and then toner images of second to fourth color are sequentially formed each time the image carrier 1 is rotated at predetermined time intervals. Toner images of K, Y, M and C are to be sequentially formed according to this embodiment of the invention. The surface of the image carrier 1 is cleaned by the blade of the cleaner unit 5 after the toner image is transferred onto the intermediate transfer belt 6.

In this case, the digital signal of K color as the first color is initially read by the optical write control unit 17 and then fed in the optical beam write unit 18, which writes a electrostatic latent image corresponding to the K color onto the surface of the image carrier 1. The electrostatic latent image corresponding to the K color is developed by the developing device K within the developing unit 3 into a visible toner image before being move into the primary transfer portion. While the toner image of K color that has arrived at the primary transfer portion is being electrostatically made to adhere to the intermediate transfer belt 6 by letting an electric field opposite to the charged polarity of the toner image act onto the toner image from the transfer corotron 4 disposed on the underside of the intermediate transfer belt 6 in the primary transfer portion, the toner image is subjected to the primary transfer by moving it to the direction of the arrow B of the intermediate transfer belt 6.

While attracting and carrying the K toner image, the intermediate transfer belt 6 moves with the same period as that of the image carrier 1. When the K toner image of the first color is completely transferred, the writing of an electrostatic latent image corresponding to the optical image subjected to color separation by the blue (B) filter on the basis of an output from the optical write control unit 17 is started until the transfer start potion of the K toner image on the intermediate transfer belt 6 is transferred to the primary transfer portion. When the transfer start position on the intermediate transfer belt 6 carrying the K toner image is transferred to the primary transfer position, the transfer of the Y toner image of the second color is transferred by the transfer corotron 4. Subsequently, electrostatic latent images corresponding to the optical images subjected to color separation by means of the green (G) and red (R) filters are respectively made visible by the developing devices M, C, and the M and C toner images are transferred like the Y toner image.

In this manner, the multiplex toner image with the superposed colors is formed on the intermediate transfer belt 6. The bias roll 9, the peeling pawl 20 and the belt cleaner 10 arranged on the surface side of the intermediate transfer belt 6 are held apart from the intermediate transfer belt 6 until the toner image with the superposed colors is primarily transferred onto the intermediate transfer belt 6.

On the other hand, the paper P received by the paper feed tray 22 is taken out by the pickup roller 23 one by one at predetermined timing and supplied to the pair of feed rolls 24 and the paper conveyer rolls 25 before being stopped by the registration rolls 27 once. Then the paper P is conveyed from the registration rolls 27 to the secondary transfer portion in synchronization with the movement of the multiplex toner image with the colors (K, Y, M, C) transferred onto the intermediate transfer belt 6.

In the secondary transfer portion, the bias roll 9 is kept in contact with the backup roll 8 via the intermediate transfer belt 6. The paper P thus conveyed is caused to pass through the secondary transfer portion after being pressure-conveyed between the rolls 8, 9 as the intermediate transfer belt 6 moves. At this time, the toner image attracted and carried by the intermediate transfer belt 6 is secondarily transferred from the surface of the intermediate transfer belt 6 to the paper P because of the electrostatic repellency caused by the application of transfer voltage having the same polarity as the charged polarity of the toner image from the electrode roll 19. When the bias roll 9 is forced to contact the backup roll 8, the foreign material such as toner particles sticking to the surface of the bias roll 9 is removed by the cleaning blade 21.

A description has been given of the transfer of a full-color image and in a case where a monochromatic image is formed, a toner image is immediately transferred onto paper P when the toner image of K color, for example, that has primarily been transferred onto the intermediate transfer belt 6 is moved to the secondary transfer portion. In a case where an image having a plurality of colors is formed, a desired hue is selected and when a multicolor toner image with the colors superposed thereon is moved to the secondary transfer portion, the toner image may be transferred onto paper P. When the multicolor image is transferred, the rotation of the image carrier 1 is synchronized with the movement of the intermediate transfer belt 6 so that the toner images having the respective colors conform to each other accurately without shifting in the primary transfer position.

As set forth above, the paper P with the toner image having the desired hue is peeled off as the peeling pawl 20 operates and mounted on the conveyer belt 28 before being conveyed to the fixing device 29. The unfixed toner image is fixed into a permanent image in the fixing device 29 and then discharged via the pair of discharge rolls 30 onto the discharge tray 31. Upon completion of the secondary transfer, the intermediate transfer belt 6 is cleaned by the belt cleaner 10 located on the downstream side of the secondary transfer portion in order to make preparations for the next transfer operation.

The image forming apparatus according to the present invention may be used as a monochromatic image forming apparatus accommodating monochromatic toner in the developing unit 3.

Manufacture of Intermediate Transfer Belt

EXAMPLE 1

First, 18 parts by weight of carbon black were added to polyimide varnish with 100 parts by weight of resin (heat-resistant coating polyimide varnish with N-methylpyrrolidone as a solvent; U varnish-S of Ube Industries, Ltd.) and thoroughly mixed by a mixer. A film-producing undiluted solution thus obtained was injected into a stainless steel cylindrical mold having a diameter of 168 mm and a height of 500 mm, and subjected to centrifugal molding while dried with a hot blast at 120° C. for 120 minutes.

Subsequently, the semi-hardened cylindrical film taken out of the mold was put on an iron core, and the solvent was evaporated by raising the temperature from 120° C. to 350° C. for 30 minutes. Further, the polyimide acid was dehydrated and condensed by heating the film at 450° C. for 20 minutes to harden it completely. The obtained 80 $\mu$m-thick polyimide film with carbon black dispersed therein was cut in widths, namely, 320 mm to form a seamless belt base (6*a*) having a surface resistivity of $10^{12}$ Ω/□. The surface resistivity of the base (6*a*) was measured by a surface resistivity meter (HR Probe of Hirester IP of Mitsubishi Petrochemical Co., Ltd.), that is, by reading a current value 30 seconds after applying a voltage of 500 V.

Further, FEP rubber paint (Daiel Latex GLS-213 of Daikin Industries, Ltd.) was applied to the surface of the belt base (6*a*) by spray coating, and the surface thereof was heated at 270° C. for 20 minutes to form a coating layer 50 $\mu$m thick (about seven times as thick as the mean toner particle diameter). The coating layer is constituted of a fluororubber layer (6*b*) or FEP 2 $\mu$m thick formed as a fluoroplastic layer (6*c*) on the surface. In this case, the contact angle θ between the surface layer (6*c*) and the waterdrop was 105°.

The intermediate transfer belt (6) thus manufactured was mounted in the image forming apparatus shown in FIG. 4 and subjected to copying tests to evaluate image quality. Test results proved that no hollow characters were found.

EXAMPLE 2

One-pack RTV type silicone rubber (SR2202 of Toray Silicone) was used to form an intermediate layer (6*b*) 50 $\mu$m thick on the surface of the seamless belt base (6*a*) obtained in Example 1. Further, the surface was coated with FEP fluoroplastic paint (ND-4 of Daikin Industries, Ltd.) 5 $\mu$m thick by spray coating, and heated at 270° C. for 20 minutes to form the surface layer (6*c*). In this case, the contact angle θ between the surface layer (6*c*) and the waterdrop was 105°.

The intermediate transfer belt (6) thus manufactured was subjected to copying tests to evaluate image quality and test results proved that no hollow characters were found.

EXAMPLE 3

As an electrically-conductive metal oxide, barium sulfate having a mean particle diameter of 0.4 $\mu$m whose surface was coated with a tin oxide electrically-conductive layer (Bustran Type - IV) and processed with τ-aminopropyl triethoxy silane was used. Then 37 parts by weight of this electrically-conductive metal oxide were added to polyimide varnish used in Example 1 with 100 parts by weight of resin and thoroughly mixed by a mixer.

The film-producing undiluted solution thus obtained was uniformly cast on a stainless steel sheet 200 μm thick, dried in an atmosphere of 120° C. for 120 minutes, further heated stepwise at 150° C. for 30 minutes, at 20° C. for 30 minutes, at 250° C. for 60 minutes, at 350° C. for 30 minutes and at 420° C. for 30 minutes so as to obtain a polyimide sheet 75 μm thick. The sheet has a surface resistivity of $10^{12}$ Ω/□.

The obtained polyimide sheet was cut into what is 540 mm long and 320 mm wide, and then heat-resistant adhesive (UPA8322 of Ube Industries, Ltd.) containing silane-modified polyimide resin was applied to one end portion 10 mm of the sheet to couple the both end portions together.

Then FEP rubber paint (Daiel Latex GLS-213 of Daikin Industries, Ltd.) was applied to the seamless belt base (6*a*) thus formed as in Example 1 and hardened to produce the intermediate transfer belt (6) of three-layer structure. When the image quality was evaluated as in Example 1, no hollow characters were found.

EXAMPLE 4

An intermediate transfer belt (6) of three-layer structure was similarly prepared as in Example 2 except that a polyimide seamless belt with electrically-conductive metal oxide formed in Example 3 was used. When the image quality was evaluated as in Example 1 then, no hollow characters were found.

Mechanical Characteristic Testing of Intermediate Transfer Belt

With respect to the intermediate transfer belt materials of three-layer structure manufactured in Examples 1–4, the bases made of 80 μm-thick polyimide resins with carbon black dispersed therein and 75 μm-thick polyimide resins with electrically-conductive metal oxide dispersed therein were tested to find their tensile rupture strength and Young's modulus (tensile elasticity modulus) according to JIS K 7127.

More specifically, the tensile rupture strength was measured by the use of a rectangular test piece of 5×40 mm at a tensile velocity of 200 mm/min, and the Young's modulus by the use of a rectangular test piece of 25×250 mm at a tensile velocity of 20 mm/min.

As comparative examples, thermosetting polyimide resin with carbon black dispersed therein (comparative example 1) as what forms Examples 1, 2, extrusion-molded thermoplastic PC (polycarbonate) with carbon black dispersed therein (comparative example 2), extrusion-molded thermoplastic ETFE (ethylene tetrafluoroethylene copolymer) with carbon black dispersed therein (comparative example 3), and thermosetting polyimide resin with electrically-conductive metal oxide dispersed therein (comparative example 4) as what forms Examples 3, 4 were used respectively as intermediate transfer belt materials for measuring the tensile rupture strength and Young's modulus. With respect to each intermediate transfer belt as a comparative example, the image quality was also evaluated as in Example 1. Incidentally, the belt materials for comparative examples 2, 3 were such that the sheet thickness was 150 μm and the surface resistivity was $10^{12}$ Ω/□.

Table 1 shows the results measured and evaluated together with the belt materials and the contact angles θ with waterdrops.

TABLE 1

| | Belt Material | | | Tensile | Young's | Contact | Image |
|---|---|---|---|---|---|---|---|
| | Base | Intermediate layer | Surface | strength (kg/cm²) | modulus (kg/cm²) | angle (°) | hollo character |
| Example 1 | Polyimide carbon black | Fluororubber | Fuluoro-plastics | 2,500 | 62,000 | 105 | ⊚ |
| Example 2 | Polyimide carbon black | Siliconerubber | Fuluoro-plastics | 2,500 | 62,000 | 105 | ⊚ |
| Example 3 | Polyimide metal oxide | Fluororubber | Fuluoro-plastics | 2,500 | 62,000 | 105 | ⊚ |
| Example 4 | Polyimide metal oxide | Siliconerubber | Fuluoro-plastics | 2,500 | 62,000 | 105 | ⊚ |
| Comparative example 1 | Polyimide carbon black | — | — | 2,500 | 62,000 | 70 | X |
| Comparative example 2 | PC carbon black | — | — | 660 | 24,000 | 75 | X |
| Comparative example 3 | ETFE carbon black | — | — | 480 | 11,000 | 100 | ○ |
| Comparative example 4 | Polyimide metal oxide | — | — | 2,500 | 62,000 | 72 | X |

Evaluation of image quality (hollow characters).
⊚: No hollow characters were generated.
○: Hollow characters were slightly generated.
X: Hollow characters were generated.

Each of the intermediate transfer belt materials shown in Table 1 according to the present invention is of three-layer structure comprising the base having a Young's modulus of 62000 kg/cm², the surface layer at a contact angle of 105° and the intermediate layer as an elastic layer.

In the case of the comparative examples 1, 4 with the base according to the present invention as belt material, on the other hand, though the belt was less deformed against the stress during the driving of the belt, toner was seen to be hardly transferable onto paper since the surface energy was high and the hollow character was generated since the Young's modulus was as great as 62000 kg/cm². In the case of the comparative example 2 with PC as belt material whose Young's modulus was as small as 24000 kg/cm$^2$, the hollow character was generated because of high surface energy as proved by a contact angle of 75°. In the case of the comparative example 3 with ETFE as belt material whose surface energy was low as proved by a contact angle of 100°, though the generation of the hollow character was only slightly observed, the belt was greatly deformed against the stress during the driving of the belt because the Young's modulus was as small as 11000 kg/cm$^2$.

The image forming apparatus and the intermediate transfer belt according to the present invention are such that its base has a greater Young's modulus and that the intermediate layer is made of elastic material, whereby the belt in operation is not greatly deformed against stress but deformed in following the pressing force of the bias roll. Therefore, the absence of stress concentration in the secondary transfer portion causes no deterioration in image quality because of the generation of hollow characters. Since the surface layer is made of non-adhesive material having low surface energy, there is no possibility that the toner image portion on the intermediate transfer belt is not subjected to secondary transfer onto a recording medium. Thus, the prevent invention makes available a transfer image of good quality.

Moreover, the method of manufacturing intermediate transfer belts according to the present invention is capable of forming the surface layer simultaneously with the intermediate layer by the use of the same fluoro-polymer material.

What is claimed is:

1. An image forming apparatus, comprising:

an image carrier for forming an electrostatic latent image corresponding to image information, a developing unit for making the electrostatic latent image formed on said image carrier visible as a toner image by use of toner made of toner particles having a diameter, an intermediate transfer belt onto which the toner image carried by said image carrier is primarily transferred, said intermediate transfer belt having a back, a bias roll for use in secondarily transferring an unfixed toner image on said intermediate transfer belt onto a recording medium, and a backup roll which is located in opposition to said bias roll and used for supporting said intermediate transfer belt from the back of said intermediate transfer belt, wherein said intermediate transfer belt is made of belt material of a three layer structure comprising a surface layer made of material having low surface energy at a contact angle of 90° or greater with a waterdrop in terms of wetting properties thereof, a combination of a base made of plastics and an electrically-conductive agent, the combination having a thickness of 50 $\mu$m or greater and having a Young's modulus of 35000 kg/cm$^2$ or greater, and an intermediate layer made of elastic material.

2. The image forming apparatus of claim 1, wherein the belt material is such that:

said base is made of polyimide resin with carbon black dispersed in said polyimide resin;

said intermediate layer is made of fluororubber; and said surface layer is made of fluoroplastics.

3. The image forming apparatus of claim 1, wherein the belt material is such that:

said base is made of polyimide resin with an electrically-conductive metal oxide dispersed in said polyimide resin;

said intermediate layer is made of fluororubber; and said surface layer is made of fluoroplastics.

4. The image forming apparatus of claim 1, wherein the belt material is such that:

said base is made of polyimide resin with carbon black dispersed in said polyimide resin;

said intermediate layer is made of silicone rubber; and said surface layer is made of fluoroplastics.

5. The image forming apparatus of claim 1, wherein the belt material is such that:

said base is made of polyimide resin with an electrically-conductive metal oxide dispersed in said polyimide resin;

said intermediate layer is made of silicone rubber; and said surface layer is made of fluoroplastics.

6. An image forming apparatus, comprising:

an image carrier for forming an electrostatic latent image corresponding to image information;

a developing unit for making the electrostatic latent image formed on said image carrier visible as a toner image by use of toner made of toner particles having a diameter, an intermediate transfer belt onto which the toner image carried by the image carrier is primarily transferred, said intermediate transfer belt having a back, a bias roll for use in secondarily transferring an unfixed toner image on the intermediate transfer belt onto a recording medium, and a backup roll which is located in opposition to the bias roll and used for supporting the intermediate transfer belt from the back of the intermediate transfer belt, wherein said intermediate transfer belt is made of belt material of three-layer structure comprising:

a base made of a combination of plastics and an electrically-conductive agent, the combination having a Young's modulus of 35000 kg/cm$^2$ or greater, the thickness of said base being 50 $\mu$m or greater, an intermediate layer made of elastic material, the thickness of said intermediate layer being at least three times as great as the mean toner particle diameter, and a surface layer made of material having low surface energy at a contact angle of 90° or greater with a waterdrop in terms of wetting properties thereof, the thickness of said surface layer being no greater than 5 $\mu$m.

7. An intermediate transfer belt made of belt material of three-layer structure comprising:

a base made of a combination of plastics and an electrically-conductive agent, the combination having a Young's modulus of 35000 kg/cm$^2$ or greater, the thickness of said base being 50 $\mu$m or greater, an intermediate layer made of elastic material, and a surface layer made of material having low surface energy at a contact angle of 90° or greater with a waterdrop in terms of wetting properties thereof.

8. An image forming apparatus comprising:

an image carrier for forming an electrostatic latent image corresponding to image information;

a developing unit for making the electrostatic latent image forned on said image carrier visible as a toner image by use of toner made of toner particles having a diameter, an intermediate transfer belt onto which the toner image carried by the image carrier is primarily transferred, a bias roll for use in secondarily transferring an unfixed toner image on the intermediate transfer belt onto a recording medium, said intermediate transfer belt having a back, and a backup roll which is located in opposition to the bias roll and used for supporting the intermediate transfer belt from the back of the intermediate transfer belt, wherein said intermediate transfer belt is made of belt material of three-layer structure comprising:

a base made of a combination of plastics and an electrically-conductive agent, said combination having a Young's modulus of 35000 kg/cm$^2$ or greater, an intermediate layer made of elastic material, and a surface layer, wherein the thickness of said base is 50 $\mu$m or greater;

the thickness of said intermediate layer is three times as great as the mean toner particle diameter or greater; and the thickness of said surface layer is 5 $\mu$m or less.

9. An image forming apparatus comprising:

an image carrier for forming an electrostatic latent image corresponding to image information;

a developing unit for making the electrostatic latent image formed on said image carrier visible as a toner image by use of toner made of toner particles having a diameter, an intermediate transfer belt onto which the toner image carried by the image carrier is primarily transferred, a bias roll for use in secondarily transferring an unfixed toner image on the intermediate transfer belt onto a recording medium, said intermediate transfer belt having a back, and a backup roll which is located in opposition to the bias roll and used for supporting the intermediate transfer belt from the back of the intermediate transfer belt, wherein said intermediate transfer belt is made of belt material of three-layer structure comprising:

a base made of a combination of plastics and an electrically-conductive agent, said combination having a Young's modulus of 35000 kg/cm$^2$ or greater, an intermediate layer made of elastic material, and a surface layer made of a material having low surface energy at a contact angle of 90° or greater with a waterdrop in terms of wetting properties thereof, wherein the thickness of said base is 50 $\mu$m or greater;

the thickness of said intermediate layer is three times as great as the mean toner particle diameter or greater; and the thickness of said surface layer is 5 $\mu$m or less.

10. A process for the production of a three-layer intermediate transfer belt for an image forming apparatus, comprising the steps of:

applying a coating liquid containing fluoro-polymer material to a base made a combination of plastics and an electrically-conductive agent and having a thickness of at least 50 $\mu$m, the combination having a Young's modulus of 35000 kg/cm$^2$ or greater, and heating the coating at 250° C. or higher so as to form an intermediate layer having a thickness of at least three times the mean toner particle diameter, the intermediate layer being made of fluororubber and a surface layer made of fluoroplastics.

* * * * *